US008746148B1

(12) United States Patent
Niedermeyer

(10) Patent No.: US 8,746,148 B1
(45) Date of Patent: Jun. 10, 2014

(54) PORTABLE VARIOUS PITCH ROPE TOW SYSTEM

(76) Inventor: Leon E. Niedermeyer, Oldsmar, FL (US)

( * ) Notice: Subject to any disclaimer, the term of this patent is extended or adjusted under 35 U.S.C. 154(b) by 158 days.

(21) Appl. No.: 13/400,311

(22) Filed: Feb. 20, 2012

Related U.S. Application Data

(60) Provisional application No. 61/447,234, filed on Feb. 28, 2011.

(51) Int. Cl.
*B61B 7/00* (2006.01)

(52) U.S. Cl.
USPC ..... 104/117

(58) Field of Classification Search
USPC ..... 104/112, 117, 117.1, 173.1–175
See application file for complete search history.

(56) References Cited

U.S. PATENT DOCUMENTS 2,677,331 A * 5/1954 Hauseman ..... 104/112
4,023,502 A * 5/1977 Elsing ..... 104/173.2
6,295,936 B1 * 10/2001 Dahlstrom ..... 104/173.2

* cited by examiner

*Primary Examiner* — R. J. McCarry, Jr.
(74) *Attorney, Agent, or Firm* — Michael J. Tavella

(57) ABSTRACT

A portable ski rope tow system, which is capable of ascending various pitched slopes. The system only needs to be anchored into snow for operation. The system consists of a main drive mechanism, a continuous loop tow rope, rope support posts that include adjustable rope guide sheave wheels, an end post that includes a rope return pulley utilizing a cable puller/come-a-long for tow rope tensioning. The system is equipped with a pull cord safety device, which runs the length of the system. A towrope clamp attached to a climbing harness is needed by the skier/snowboarder to eliminate hand fatigue and mainly to be able to pass through rope guide sheave wheels. Most of the structural components of the system are lightweight, made of aluminum to provide easier mobility, set up and take down.

18 Claims, 11 Drawing Sheets

PORTABLE VARIOUS PITCH ROPE TOW SYSTEM

CROSS REFERENCE TO RELATED APPLICATIONS

This application claims benefit of Provisional application 61/447,234 filed Feb. 28, 2011

STATEMENT REGARDING FEDERALLY SPONSORED RESEARCH AND DEVELOPMENT

Not Applicable

BACKGROUND OF THE INVENTION

1. Field of the Invention

This invention relates to ski rope tow system and particularly to portable ski rope tow systems, which are capable of ascending various pitched slopes.

2. Description of the Prior Art

Today, ski facilities uses two main systems for moving skiers to the top of a ski run. The first is the chair lift and the second is the towline. Towlines have been in use longer than chair lifts as they are much easier to install. At traditional ski areas, these lifts are usually permanently installed. That means setting poles or supports in the ground at specific places and installing all of the necessary equipment needed to operate them.

Alternatively, temporary towlines may be installed at locations. These towlines usually have a two posts and a line, on pulleys, strung between them. The problem with is system is that there is no way to extend the line to more than one post as there is no simple way for the tow bar from pass from post to post. The tow bar is attached to the towline and is held by the skier on the way up the slope. Another problem with these temporary towlines is that they cannot be installed on uneven terrain. The problem here is with uneven terrain. The towline may contact the ground unless the posts are unreasonably close together.

BRIEF DESCRIPTION OF THE INVENTION

The instant invention solves these problems. It is a portable ski rope tow system, which is capable of any length. It is also easily able to ascend various pitched slopes. The system only needs to be anchored into snow for operation. The system consists of a main drive mechanism, a continuous loop tow rope, rope support posts that include adjustable rope guide sheave wheels, and an end post that includes a rope return pulley utilizing a cable puller/come-a-long for tow rope tensioning. The system is equipped with a pull cord safety device, which runs the length of the system. A unique towrope clamp that is removably attached to a climbing harness is used by the skier/snowboarder to move up the slope. The unique design allows the clamp to pass over the rope guide sheave wheels, which enables the system to use multiple posts for long runs and to deal with any terrain issues that might be encountered. The unique clamp also eliminates hand fatigue for the users. Most of the structural components of the system are lightweight aluminum to provide easier mobility, set up and take down.

DETAILED DESCRIPTION OF THE INVENTION

Figure 1:
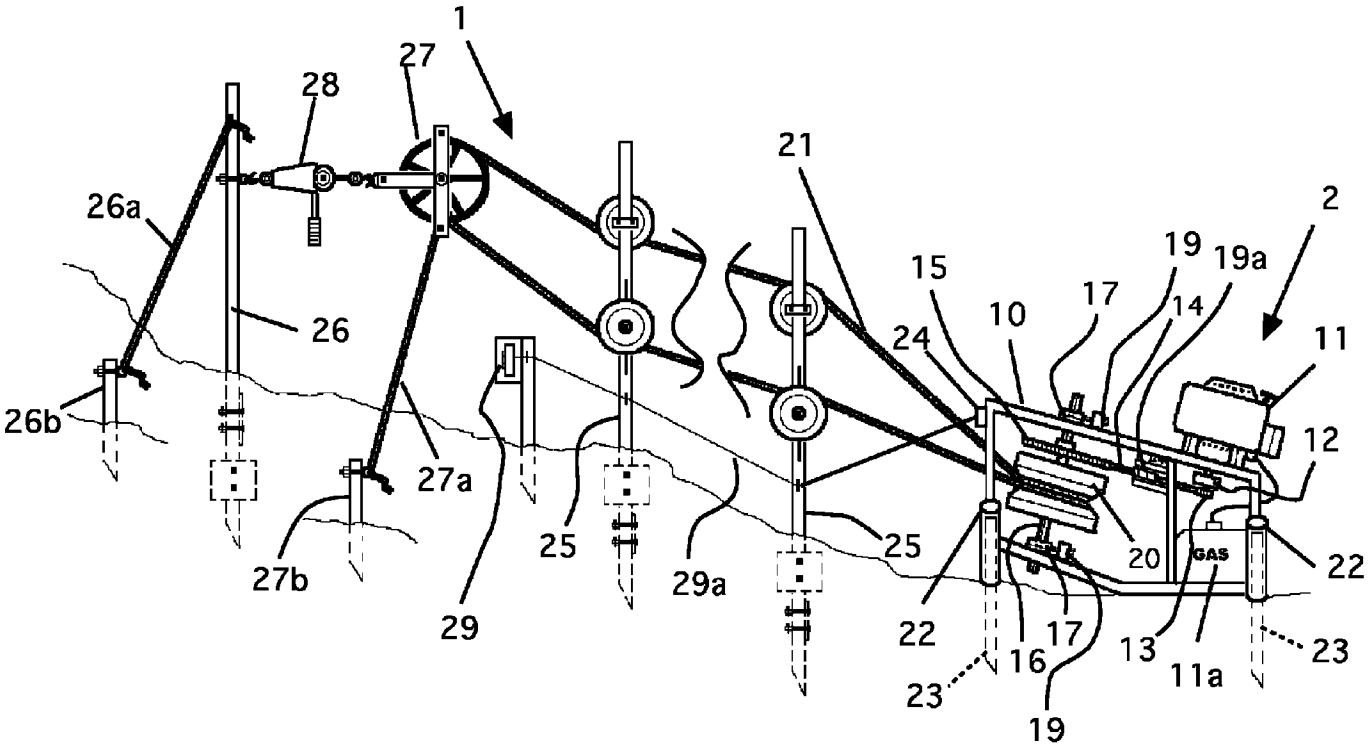
FIG. 1 is a side view of the system.

Referring now to FIG. 1, a side view of the system 1 is shown. The system has a number of components. First, there is a main drive unit 2 that consists of an aluminum mainframe 10, which supports a gas powered, air-cooled, vertical drive shaft engine 11. The engine is supplied from a gas tank, 11*a*, which is mounted in the bottom of the frame 10. Of course, any similar type of engine or motor can be used. Gas is preferred as a fuel because the invention is preferably used in remote areas as a temporary ski tow in areas in which electricity is not normally available. A centrifugal clutch 12 is attached to the drive shaft of the engine 11 (see FIG. 2). A sprocket 13, which allows load free starting from the clutch, runs a chain 14. The chain 14 is attached to a keyed hub sprocket 15, which runs a keyed drive shaft 16 (see FIG. 2). The drive shaft 16 has top and bottom flange block bearings 17. The bearings and drive shaft are mounted on plates 18 with slotted holes to adjust chain tension, the chain tension is held with tension bolts/blocks, which hold bearings with fitted blocks 19 along with a tensioning arm 19*a*. The drive shaft 16 is held in place by set screws on the bearing and also by collars 12*a* added on the topside of the top bearing and the underside of the bottom bearing (see FIG. 2). A bull wheel/rim 20 runs a towrope 21. The rim 20 is attached to the drive shaft 16 with a keyed hub. The rim/rim 20 works as a capstan pulley with the towrope 21 wrapped once around it to provide bite on the rope.

Attached to the mainframe 10 are cylindrical pockets 22 that hold anchoring posts 23 for the main drive system 2. Here, mainframe 10, which supports a gas powered, air-cooled, vertical drive shaft engine 11. Of course, any similar type of engine or motor can be used. A centrifugal clutch 12 is attached to the drive shaft 16 of the engine 11 (see FIG. 2). A sprocket 13, which allows load free starting from the clutch, runs a chain 14. The chain 14 is attached to a keyed hub sprocket 15, which attaches to the keyed drive shaft 16 (see FIG. 2). The drive shaft 16 has top and bottom flange block bearings 17. The bearings and drive shaft are mounted on plates 18 with slotted holes to adjust chain tension, the chain tension is held with tension bolts/block which hold bearings with fitted blocks 19. The drive shaft 16 is held in place by set screws on the bearing and also by collars 12*a* added on the topside of the top bearing and the underside of the bottom bearing (see FIG. 2). A rim/rim 20 runs a towrope 21. The rim 20 is attached to the drive shaft 16 with a keyed hub. The rim/rim 20 works as a capstan pulley with the towrope 21 wrapped once around it to provide bite on the rope.

Also attached to the mainframe 10 is pull-cord kill switch 24 that ties to the engines main kill switch 24*a*, as discussed below.

The towrope 21 runs outward from the main drive system 2 to run up a slope. To support the rope, a number of support posts 25 are placed at points along the slope. As discussed below, the support posts have sheaves to allow the rope to run both up and down the slope as the tow system is operated. At the top of the slope and end post 26 is installed. The end post is guyed with a rope 26*a* to a stake 26*b* to ensure the end post remains stable. A pulley 27 is attached to the end post by means of a cable puller/come along 28 that ensures proper tension on the rope 21 is maintained. Note that the pulley 27 has a guy line 27*a* and a stake 27*b*, which are used to ensure that the pulley 27 remains in a vertical orientation during operation.

In the preferred embodiment, the total length of the towline can vary from 300 to 2,400 feet. To accomplish this the number of posts 25 varies. The distance between posts is called a "pitch" and for the 2,400 foot length requires at least 7 posts, spread approximately 300 feet apart. The minimum system uses two posts spaced about 300 feet apart. One unique feature of this system is that it can operate on uneven terrain. The requirement for operation is that the rope 21 is held above the surface of the snow. Thus, conditions may require additional posts to provide a smooth operation over the entire length of the tow.

FIG. 1 also shows a safety gate 29 that has a line 29*a* that runs down to the pull-cord kill switch 24. This is a safety device that shuts down the motor is a user cannot disengage from the rope. If that happens, the user will hit the gate, which will pull the line, and shut down the engine. One advantage of the safety line is that a user can grab the line at any time during the run and pull it to shut down the engine in an emergency.

More specific details of the system are discussed below.

Figure 2:
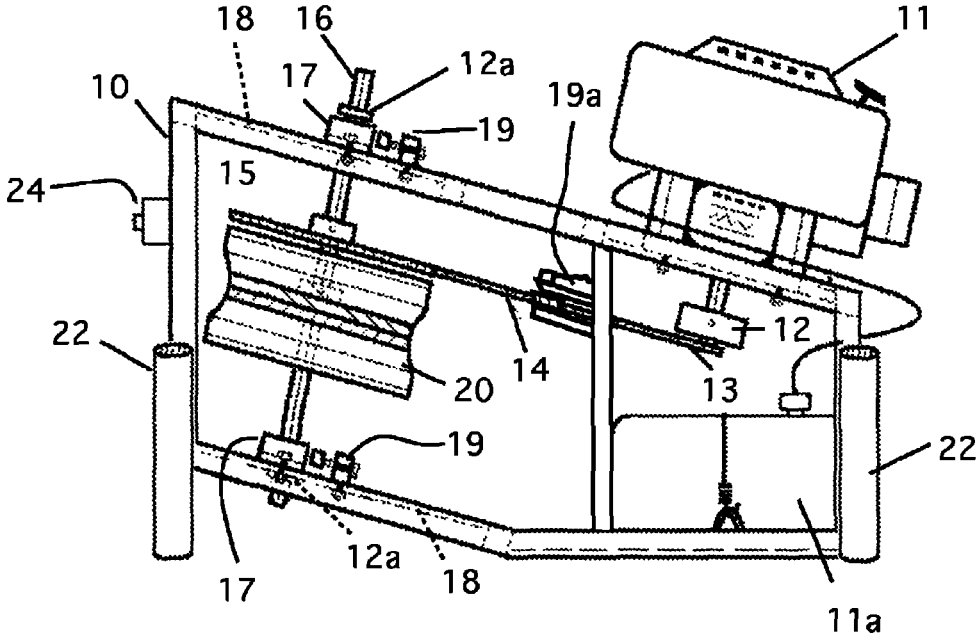
FIG. 2 is side view of the main drive system.
Figure 3:
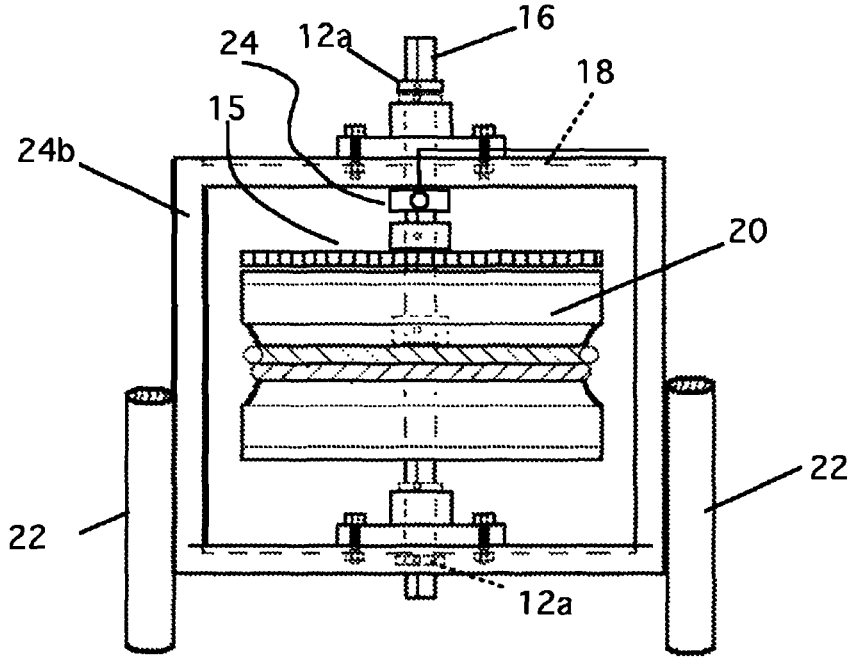
FIG. 3 is a front view of the main drive system.
Figure 4:
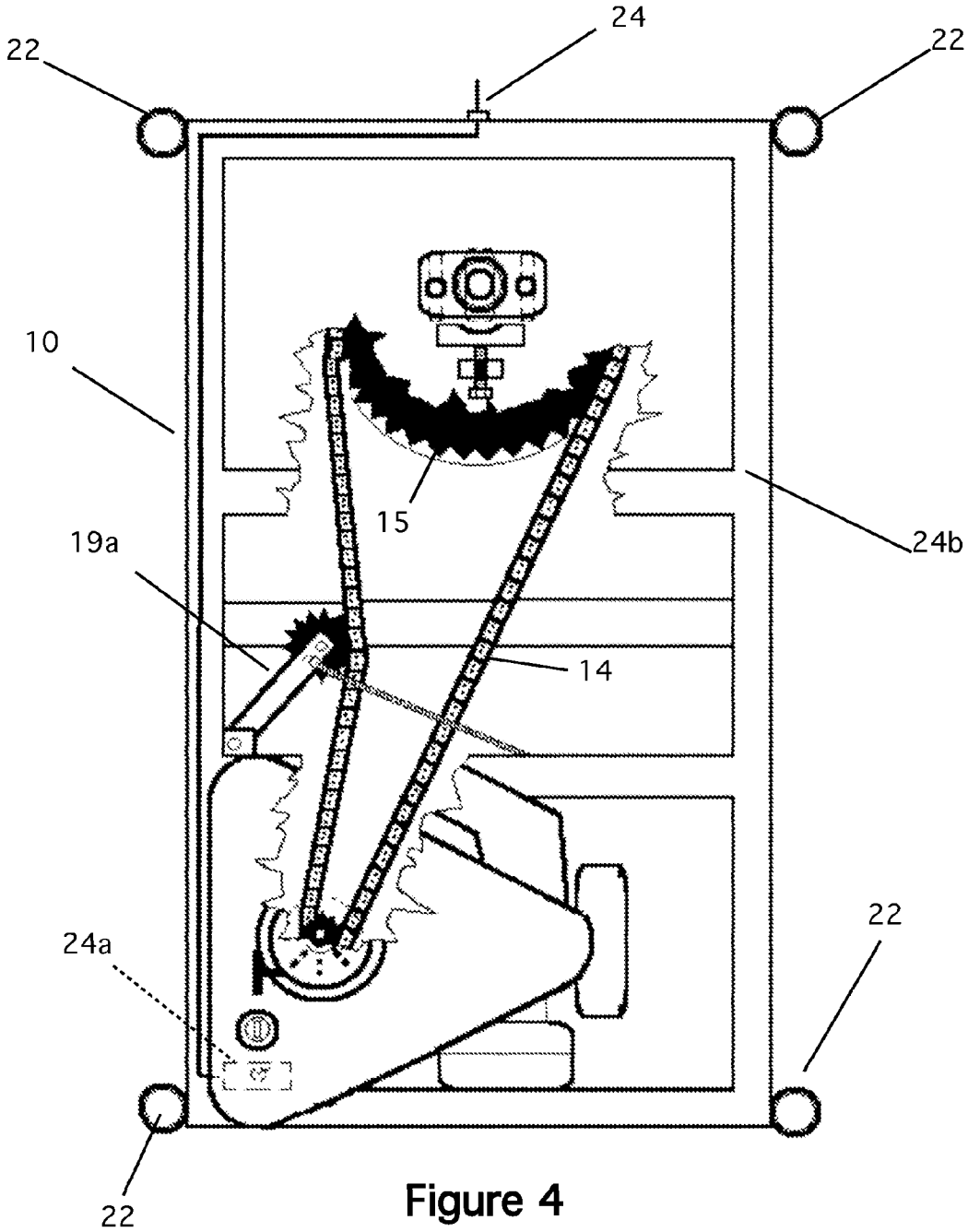
FIG. 4 is a top view of the main drive system

FIGS. 2, 3 and 4 are side, front and top views of the main drive system, respectively. Here, details of the drive system are shown in better detail. The mainframe 10, the vertical drive shaft engine 11, the centrifugal clutch 12, the drive shaft 16 of the engine 11, the sprocket 13, the chain 14, the keyed hub sprocket 15, the top and bottom flange block bearings 17, the plates 18, the fitted blocks 19, the collars 12*a*, the pockets 22, and the rim/rim 20 are all shown.

FIGS. 3 and 4 also show the connection for the kill switch 24 that attaches to the pull cord 29*a*. This switch is mounted on the front of the frame and is wired to the main engine kill switch 24*a* by wires 24*b*. In this way, the engine is shut down, as described above.

Figure 5:
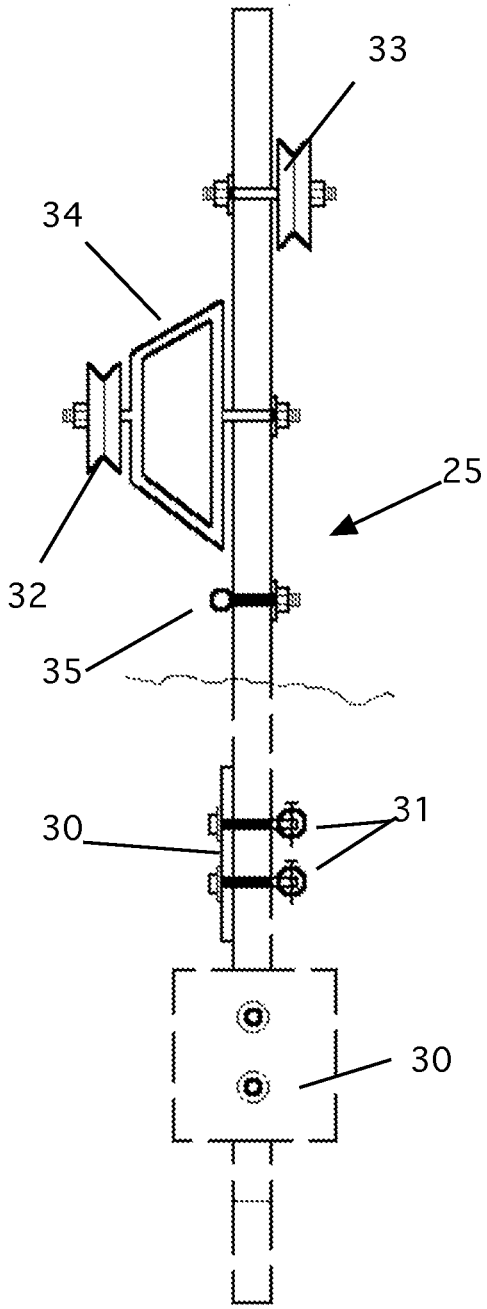
FIG. 5 is a front view of a rope support post that includes adjustable rope guide sheave wheels.
Figure 6:
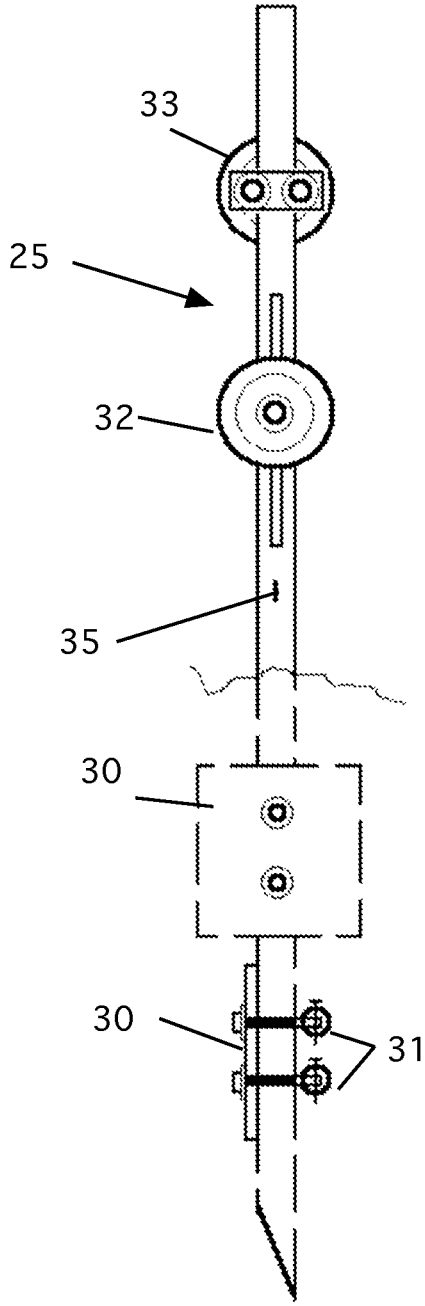
FIG. 6 is a side view of a rope support post that includes adjustable rope guide sheave wheels.

FIGS. 5 and 6 are a side view and a front view of the rope support posts 25. These figures show details of the support posts 25. The posts are planted into the snow along the route of the towline. The posts 25 have stability plates 30 installed on the side and face of the post 25 as shown. The stability plates are connected with clevis pins 31 for fast and easy attachment. The towrope runs uphill passing over the uphill sheave 32. The rope can ride over the top or bottom of the sheave wheel depending on incline, to ensure proper tensioning of towrope. The downhill sheave 33 is spaced differently than the uphill sheave 32. The uphill sheave 32 is held away from the post by a bracket 34 to keep the user away from the posts. If the towrope comes out of the sheave wheel, it can be easily placed back into the wheel.

Each post also has an eye bolt 35 installed, through which the safety pull cord 29*a* passes on its way to the safety gate at the top of the towline run.

Figure 7:
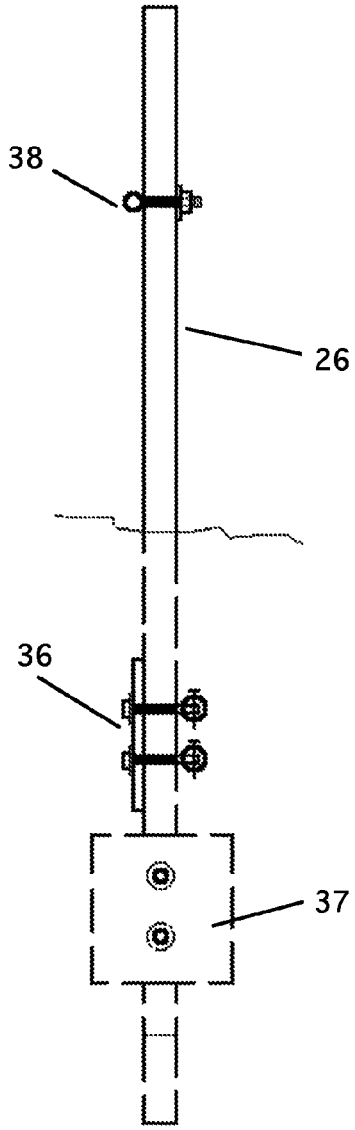
FIG. 7 is a side view of the end post that mounts the towrope return pulley and cable puller/come-a-long.
Figure 8:
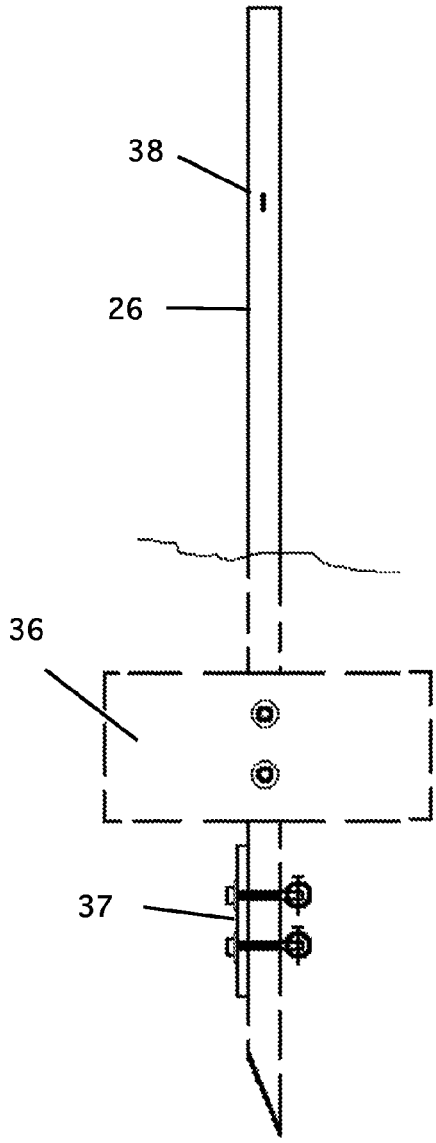
FIG. 8 is a front view of the end post that mounts the towrope return pulley and cable puller/come-a-long.

FIGS. 7 and 8 are a side view and a front view of the end post 26 that terminates the towrope and holds the return pulley 27 and cable puller/come-a-long 28. The end post 26 has a larger stability plate 36 to provide support for the towrope tension in the direction of the towrope, and a smaller plate 37 for lateral support. The end post has an eyebolt 38, which is used for mounting the cable puller/come-a-long 28 as shown in FIG. 1. As noted, the towrope return pulley 27 is attached to the cable puller 27. As shown in FIG. 1, the end post 26 is further supported on both sides with ropes 26*a* tied to stakes 26*b* for extra support.

Figure 9:
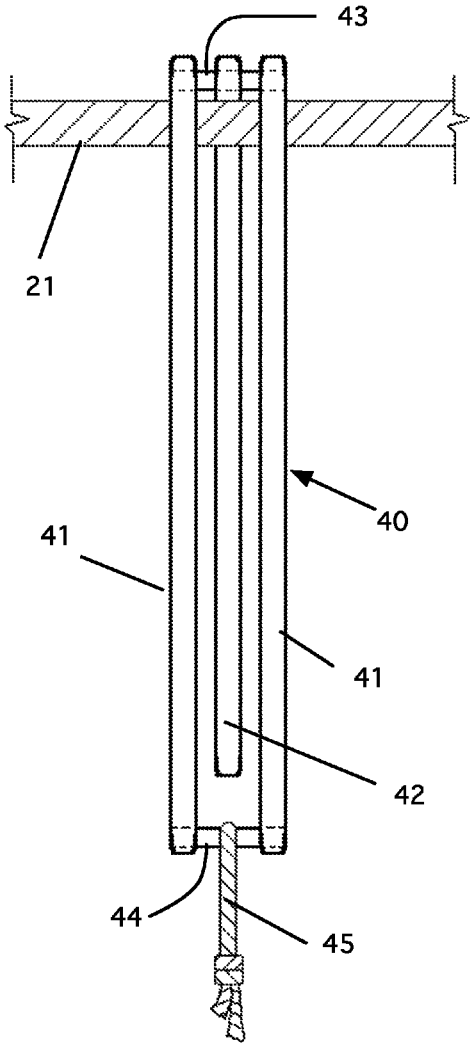
FIG. 9 is a top view of a towrope clamp shown in the closed position.
Figure 10:
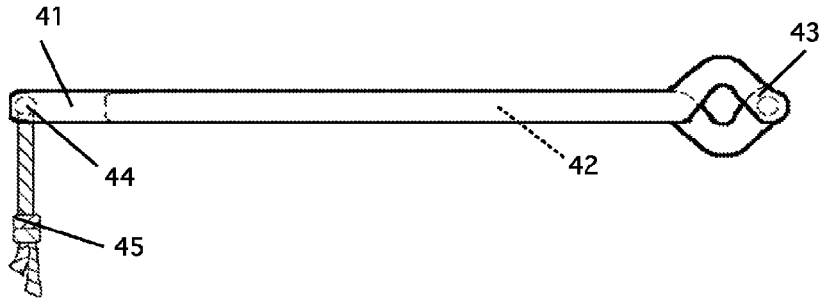
FIG. 10 is a side view of a towrope clamp shown in the closed position.
Figure 11:
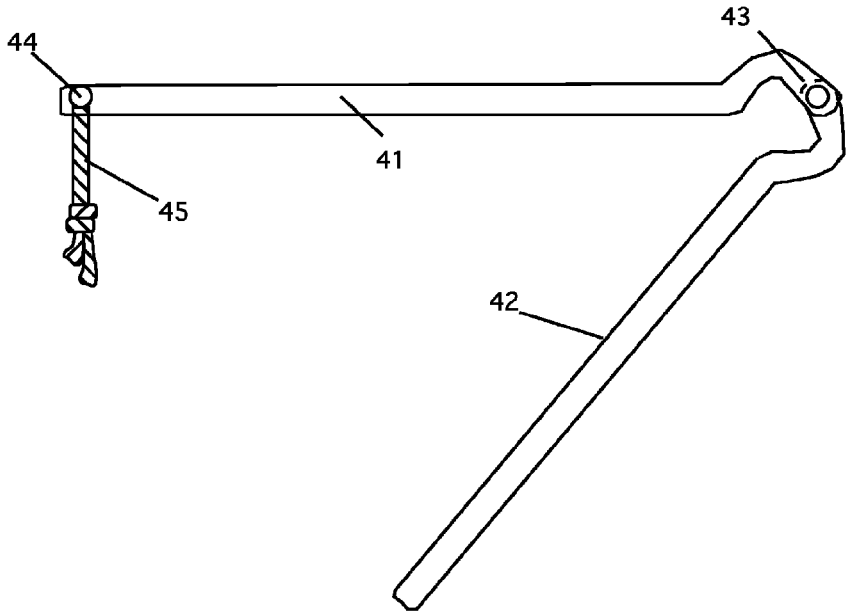
FIG. 11 is a side view of a towrope clamp shown in the partially open position.

FIG. 9 is a top view of a towrope clamp 40 shown in the closed position. This clamp is the key to enabling multiple pitches over several pulleys. Without this clamp, users could not safely go past the pulleys on successive posts. The clamp has two side members 41 and a central pivoting arm 42 that pivots on a pin 43. The clamp has a second pin 44, to which a rope 45 is attached. The user attaches the rope to a climbing harness using a carabineer (not shown). As shown in FIGS. 9, 10 and 11, the clamp 40 fits over the towrope 21 (see FIG. 9). To attach the clamp to the towrope, the user drops the center arm (see FIG. 11), and slips it over the rope 21*b*. The user then lifts the center arm up to the position shown in FIG. 10. The user then holds the clamp such that the center arm remains horizontal (FIG. 10). In this way, the towrope is held firmly by the clamp. As the towrope moves, the user rides up the slope with the rope. When the user arrives at a pulley sheave, the clamp simply rides over the top (or under the bottom) of the sheave and the user continues on the way up the mountain. At the top of the run, the user simply releases the clamp and the clamp is removed from the towrope. In the event of a problem, and the user cannot remove the clamp, the user will reach the safety gate, which will shutdown the engine as discussed below. At any time during the run, if a user experiences a problem, the user can pull the safety line 29*a* to shutdown the engine as well.

FIG. 10 is a side view of a towrope clamp shown in the closed position. In this view, the central pivoting arm 42 is shown in hidden lines. Note that the top end of the arm is shown below the side members 41. The pinned end of the central pivoting arm 42 extends downward as shown and the side members 41 are curved upwards, to form a small opening into which the towrope is placed (see FIG. 9). As noted above, the user holds the central pivoting arm 42 between the side members 41 to retain the towrope in the clamp. When the device is in operation, the towrope pulls the clamp and thus the rider along the run.

FIG. 11 is a side view of a towrope clamp shown in the partially open position. As noted above, to attach or remove the clamp 40 from the towrope, the user releases the central pivoting arm 42, which then drops downward as shown in the figure.

Figure 12:
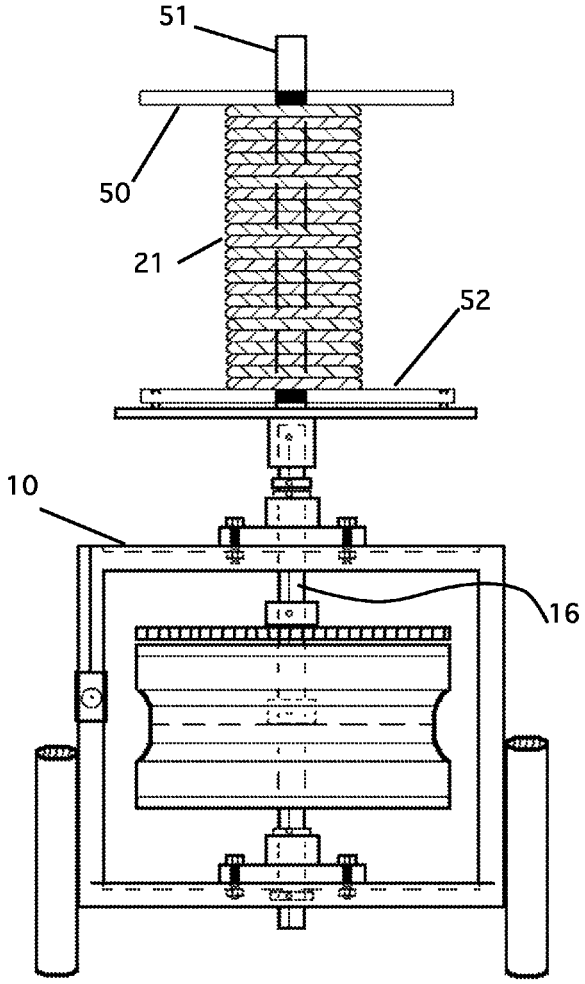
FIG. 12 is a side view of the towrope-coiling reel system, which mounts to main drive system.

FIG. 12 is a side view of the towrope-coiling reel. The reel 50 fits over the top of the drive shaft 16. The reel is used to deploy the towrope 21 when entire system is being set up and to the coil the towrope 21 after use. The reel is used as follows: to deploy the rope, the end post & pulley are set. A smaller diameter rope (not shown) (e.g., ⅛ inch, with which it is easier to make the initial ascent is taken to the top of the run. The smaller rope is run from the base frame after being tied to an end of the towrope that is spooled on the reel. The smaller rope is then run through the pulley and then to an empty spool mounted to the bracket. Once the engine is engaged, it will do the work of pulling the towrope. Other rope support posts may be used to prevent rope damage. To coil the towrope, the towrope is secured to the reel on top of the shaft. As the engine runs, the rope is coiled on the reel until is completely removed from the run.

Figure 13:
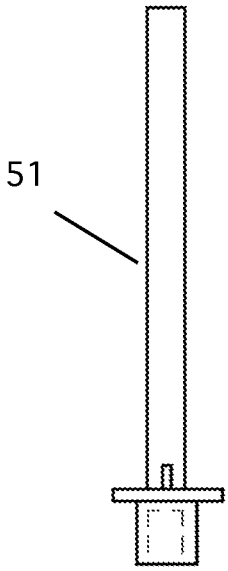
FIG. 13 is a side view of the coiling shaft.

FIG. 13 is a side view of the coiling shaft 51. This shaft is secured to the drive shaft using the reel bracket 52 (see FIG. 14).

Figure 14:
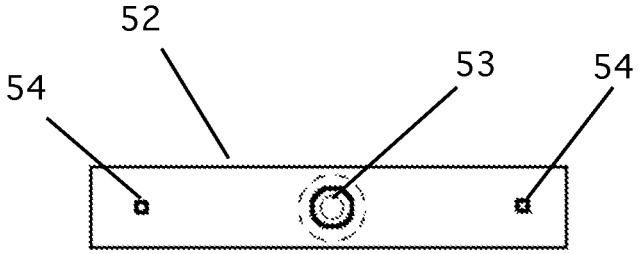
FIG. 14 is a top view of the reel bracket.

FIG. 14 is a top view of the reel bracket 52. As shown, the bracket has a center hole 53 that holds the shaft 51, and two smaller mounting holes 54.

Figure 15:
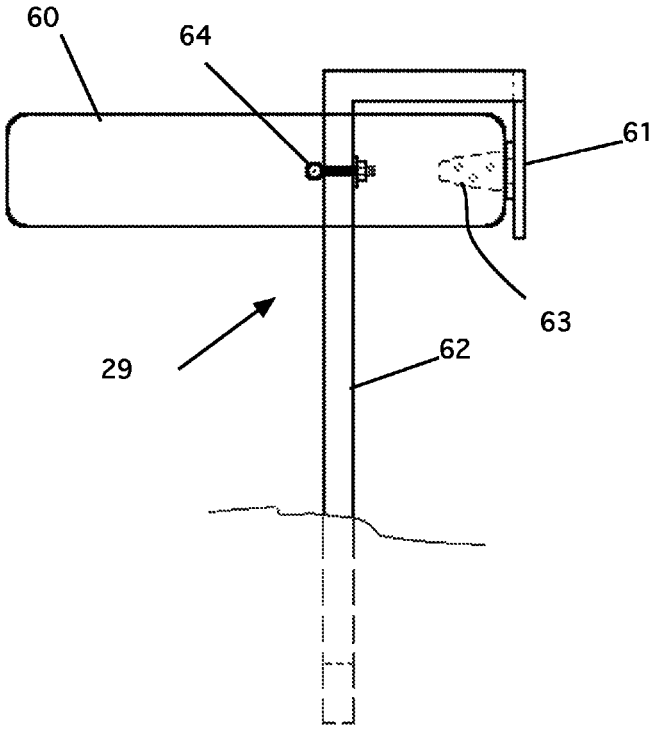
FIG. 15 is a front view of the safety gate for the pull cord safety device.
Figure 17:
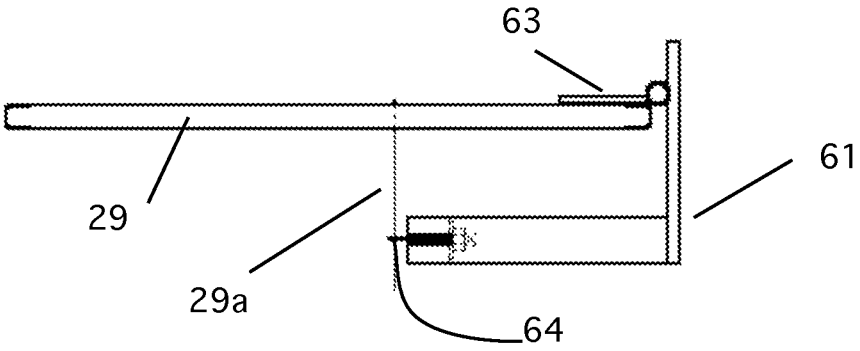
FIG. 17 is a top view of the top safety gate for the pull cord safety device.
Figure 16:
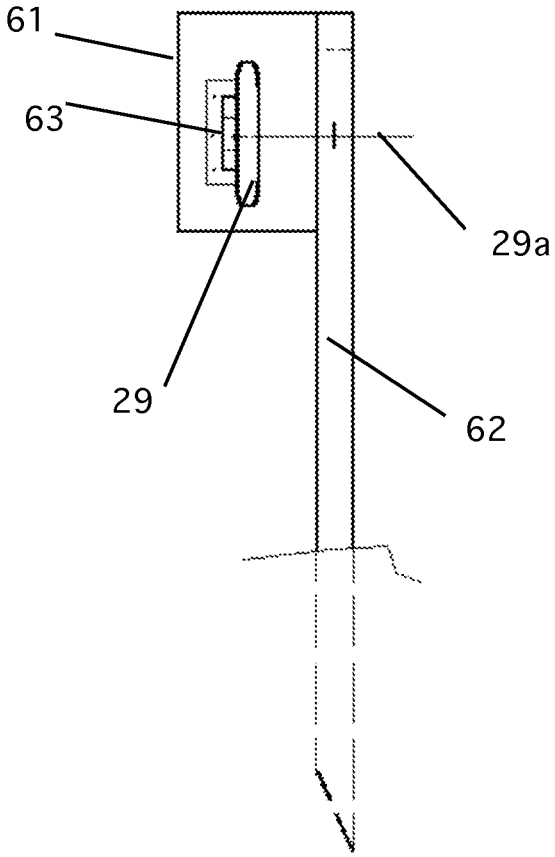
FIG. 16 is a side view of the top safety gate for the pull cord safety device.

FIGS. 15, 16 and 17 show details of the safety gate 29. FIG. 15 is a side view showing the gate 60, which is attached to a side plate 61, which is part of a support post 62 by a hinge 63. Referring now to FIGS. 16 and 17, the safety line 29*a* passes through an eye 64 that is attached to the post 62. It then attaches to the gate 60. If a skier is stuck on the towrope and is unable to remove the clamp, the user will contact the gate. This action pushes the gate back, which pulls the safety line 29. This causes the engine to shut down and stop the towrope.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A portable various pitch rope tow system comprising:

a) at least two support posts, placed along a tow route, each of said at least two support posts having two adjustable rope guide sheave wheels attached thereto;

b) a continuous loop towrope passed over said adjustable rope guide sheave wheels;

c) an end post that includes a rope return pulley around which said continuous loop towrope is passed;

d) a) a main drive mechanism, having a drive motor and a main bull wheel around which said continuous loop towrope is passed;

e) a towrope clamp, slidably attached to said continuous loop towrope;

f) a safety gate, pivotably attached to a post in line with said rope tow system and being positioned near said end post; and g) a safety line having a first end attached to said safety gate, said safety line extending downwardly from said gate, and being attached to each of said at least two posts, and further wherein a second end of said safety line being attached to said safety cutoff switch attached to said main drive mechanism.

2. The rope towing system of claim 1 further comprising a means for tensioning said continuous loop towrope.

3. The rope towing system of claim 1 further comprising a safety cutoff switch attached to said main drive mechanism, whereby when said safety cutoff switch is activated, the movement of said continuous loop towrope ceases.

4. The rope towing system of claim 1 wherein said towrope clamp comprises:

a) a pair of side members;

b) a central pivoting arm; placed between said pair of side members, said central pivot arm being pivotably attached to said towrope clamp; and c) a pivot pin, attached to said towrope clamp.

5. The rope towing system of claim 2 wherein the means for tensioning said continuous loop towrope comprises a cable puller, attached between said rope return pulley and said end post, such that said cable puller can adjust the position of said rope return pulley with respect to said end post to ensure proper tension on said continuous loop towrope.

6. The rope towing system of claim 5 further comprising at least one guy line, attached to said end post.

7. A portable various pitch rope tow system comprising:

a) a plurality of support posts, placed along a tow route, each of said plurality of support posts having two adjustable rope guide sheave wheels attached thereto;

b) a continuous loop towrope passed over said adjustable rope guide sheave wheels;

c) an end post that includes a rope return pulley around which said continuous loop towrope is passed;

d) a) a main drive mechanism, having a drive motor and a main bull wheel around which said continuous loop towrope is passed;

e) a towrope clamp, slidably attached to said continuous loop towrope f) a safety gate, pivotably attached to a post in line with said rope tow system and being positioned near said end post; and g) a safety line having a first end attached to said safety gate, said safety line extending downwardly from said gate, and being attached to each of said at least two posts, and further wherein a second end of said safety line being attached to a safety cutoff switch attached to said main drive mechanism.

8. The rope towing system of claim 7 further comprising a means for tensioning said continuous loop towrope.

9. The rope towing system of claim 8 wherein the means for tensioning said continuous loop towrope comprises a cable puller, attached between said rope return pulley and said end post, such that said cable puller can adjust the position of said rope return pulley with respect to said end post to ensure proper tension on said continuous loop towrope.

10. The rope towing system of claim 9 further comprising at least one guy line, attached to said end post.

11. The rope towing system of claim 7 whereby when said safety cutoff switch is activated the movement of said continuous loop towrope ceases.

12. The rope towing system of claim 7 wherein said towrope clamp comprises:

a) a pair of side members;

b) a central pivoting arm; placed between said pair of side members, said central pivot arm being pivotably attached to said towrope clamp; and c) a pivot pin, attached to said towrope clamp.

13. The rope towing system of claim 7 wherein the plurality of support posts is positioned over uneven terrain.

14. The rope towing system of claim 7 wherein said plurality of support posts is positioned apart over a total distance of 2,500 feet.

15. The rope towing system of claim 7 wherein each of said plurality of support posts are position about 300 feet apart.

16. The rope towing system of claim 7 wherein on each of said plurality of support posts, one of said two adjustable rope guide sheave wheels is held away from the post.

17. The rope towing system of claim 7 further comprising at least one stability plate installed on each of said plurality of support posts.

18. The rope towing system of claim 7 further comprising a first stability plate installed on a side of each of said plurality of support posts, and a second stability plate installed on a face of each of said plurality of support posts.

* * * * *